US006494601B2

(12) United States Patent
Johnson

(10) Patent No.: US 6,494,601 B2
(45) Date of Patent: Dec. 17, 2002

(54) MODULAR CLUSTER LIGHTING FIXTURE

(75) Inventor: Dennis E. Johnson, Grafton, WI (US)

(73) Assignee: SPI Lighting, Inc., Mequon, WI (US)

( * ) Notice: Subject to any disclaimer, the term of this patent is extended or adjusted under 35 U.S.C. 154(b) by 0 days.

(21) Appl. No.: 09/829,317

(22) Filed: Apr. 9, 2001

(65) Prior Publication Data

US 2002/0145877 A1 Oct. 10, 2002

(51) Int. Cl.[7] ..... F21S 8/06
(52) U.S. Cl. ..... 362/406; 362/147; 362/396
(58) Field of Search ..... 302/404, 405, 302/406, 407; 362/396, 147

(56) References Cited

U.S. PATENT DOCUMENTS

| | | | | |
|---|---|---|---|---|
| 1,680,094 A | | 8/1928 | Doane | |
| 4,079,244 A | * | 3/1978 | Bortoluzzi | 362/405 |
| 5,329,434 A | | 7/1994 | Hong | 362/238 |
| 5,941,631 A | * | 8/1999 | Hsu | 362/363 |

OTHER PUBLICATIONS

SPI's p. 7, Model CC815, undated, admitted prior art.
Page from brochure of Elementer Lighting Limited, Gino Chandelier, undated, admitted prior art.

* cited by examiner

*Primary Examiner*—Sandra O'Shea
*Assistant Examiner*—John Anthony Ward
(74) *Attorney, Agent, or Firm*—Quarles & Brady LLP

(57) ABSTRACT

Disclosed herein is a modular cluster lighting fixture having a plurality of lamp supports for mounting lamps connected to each other by a plurality spacers. The lighting fixture can be suspended by a plurality of tubular hangers connected to the lamp supports and in which pairs of electrical conductors are disposed for supplying energy to the lamps. Preferably, each lamp support includes a two-piece clamp body and two tubular support arms. The clamp bodies mount the support arms at one or more sides and are clamped around ends of the spacers. The clamp bodies have an opening at a top side for receiving an end of a hanger, preferably at a pivotal connection.

10 Claims, 5 Drawing Sheets

FIG. 4
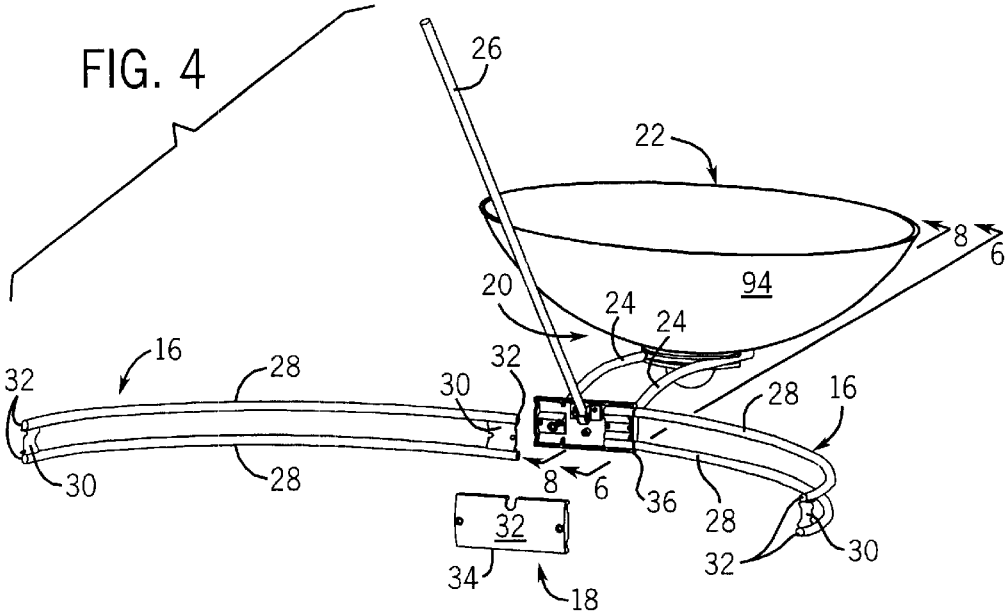
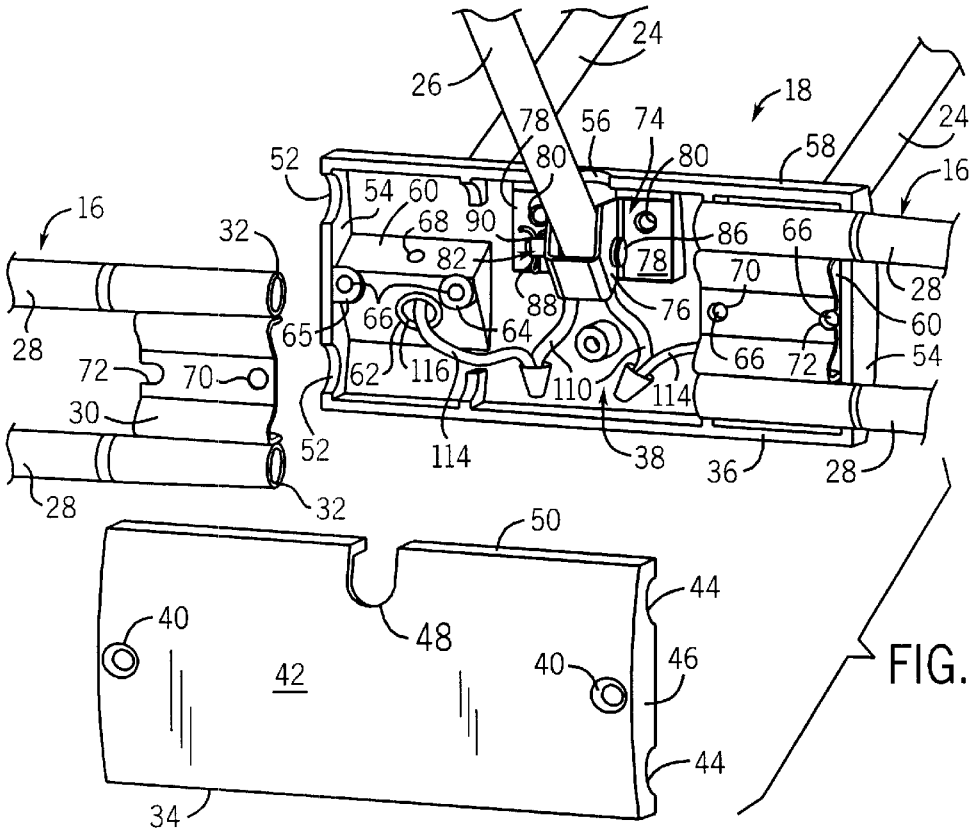
FIG. 5

FIG. 12
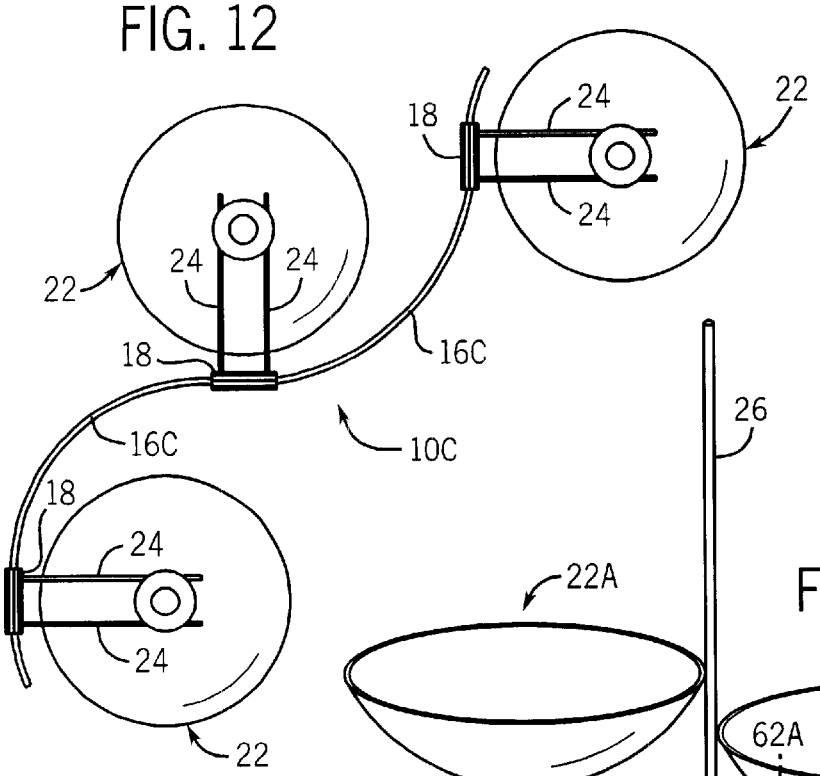
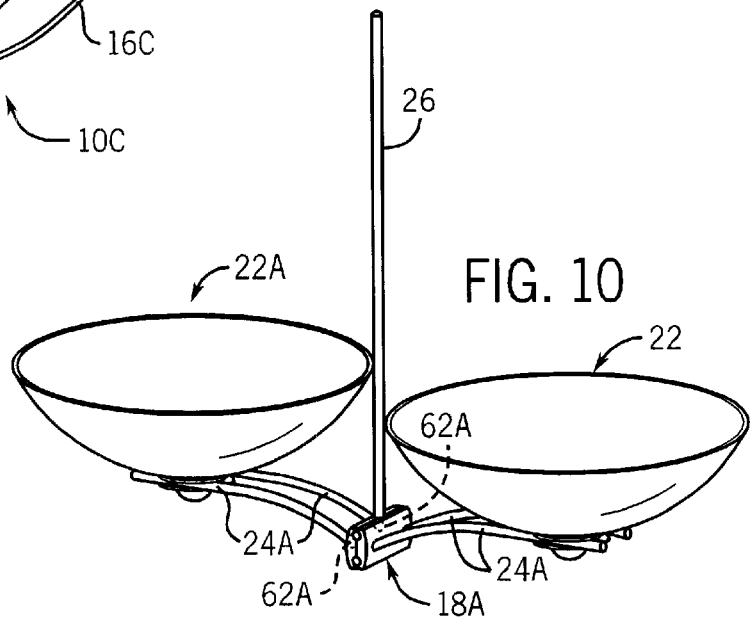
FIG. 10
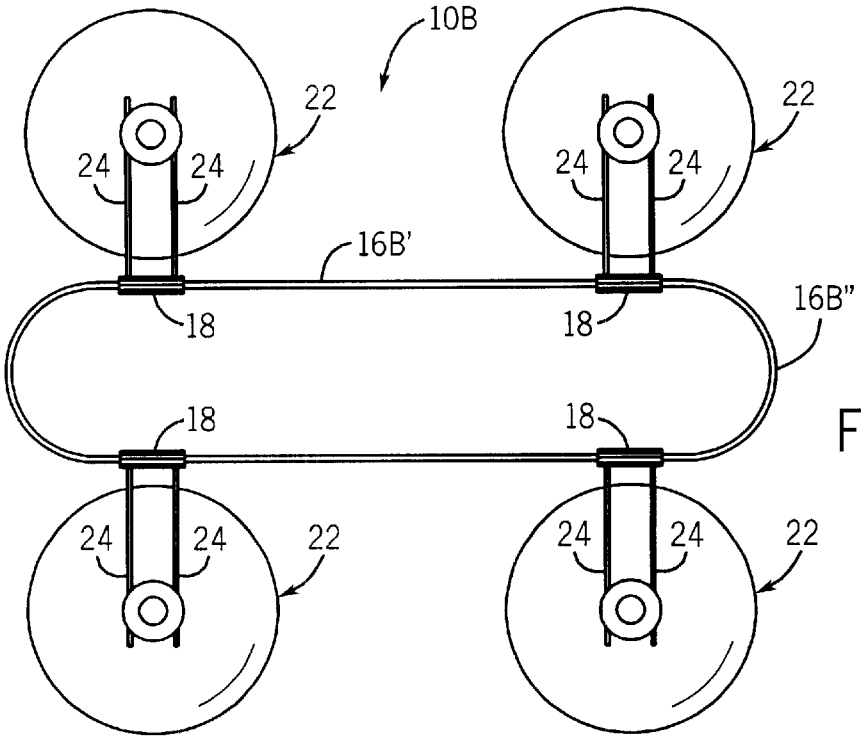
FIG. 11

MODULAR CLUSTER LIGHTING FIXTURE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to lighting fixtures and in particular to a modular lighting fixture that can be assembled in various configurations.

Home and work spaces typically have some type of fixture for mounting one or more light bulbs, be it incandescent, flourescent or otherwise. Lighting fixtures that suspend light bulbs from a ceiling or wall must include a means for running the electric conductors from the electric wiring of the building to the light bulbs. It is usually desired to conceal the electrical conductors for aesthetic reasons. This is particularly true for cluster lighting fixtures having numerous light bulbs, and thus multiple electrical lines.

Lighting fixtures have been developed that have hollow hangers acting as conduit for the electrical conductors. An example of such a lighting fixture is given in U.S. Pat. No. 1,680,094 which defines a spoked fixture with lamps fixed at the ends of the spokes.

This fixture and other conventional cluster lighting fixtures do not provide the flexibility to change the number or position of the light bulbs because the light bulbs typically branch from a center base or circular (or otherwise) banding. For users wishing a different number or position of lights, suppliers must inventory a wide variety of different structures.

Some modular lighting fixtures have been developed with separate spacer components that can be connected in various orientations to change the configuration of the lighting fixture as well as increase or decrease the number of lamps. An example of such a lighting fixture is given in U.S. Pat. No. 5,329,434.

Existing cluster lighting fixtures, however, typically require time consuming rewiring or reconstruction when changing the configuration of the fixture or when adding or removing one or more lamps to the fixture.

Accordingly, an improved modular cluster lighting fixture is desired.

SUMMARY OF THE INVENTION

The present invention provides an improved cluster lighting fixture comprised of modular components allowing for the overall configuration of the lighting fixture to be changed readily.

In particular, the present invention provides a lighting fixture suspended from above by a hanger and having a plurality of lamps supported by a plurality of lamp supports. Two of the lamp supports are joined together removably by a spacer structure. Electrical wiring extends along the hanger through the lamp supports and to the lamps.

In a preferred form, each lamp support includes a clamp body and two tubular support arms. Each clamp body includes inner and outer parts that clamp around ends of the spacers, which can be tubular or solid and arcuate or rectilinear. The inner and outer parts have an opening at a top side for receiving an end of a hanger and one or more of the parts have openings for receiving the ends of the support arm. Mounting brackets fastened to the inside of the clamp body engage and hold the spacers to the clamp body. Pairs of electrical conductors for the lamps can run through the hangers and in between the inner and outer parts of the clamp bodies. Other pairs of conductors run through the support arms from the clamp bodies to the lamps.

In another preferred form, the lighting fixture includes plurality of lamps and a lamp support, suspended by a hanger, for supporting the lamps. The lamp support has a clamp body and support arm structures removably extending from opposite sides of the clamp body to support lamps on opposite sides of the clamp body.

In another preferred form, the hangers connect to the clamp bodies at pivotal connections.

In yet another preferred form, one or more of the plurality of lamp supports includes two or more support arms extending from opposite sides of the clamp bodies. In such lamp supports, both the inner and outer parts have one or more openings for receiving support arms.

In still another preferred form, the spacers and the lamp supports are connected to form a closed path, such as a circle, triangle, oval, square or rectangle. In this case, a correspondingly shaped lens can be placed onto the lighting fixture within the closed path. Alternatively, the lighting fixture can form an open-ended path, such as an a wavy or S-curve configuration.

Thus, the present invention provides a lighting fixture that can be easily assembled into various configurations and to have any number or configuration of lamps. This is accomplished by connecting the suspension elements and the lamps to lamp supports, thereby allowing the spacers to be of any configuration and the lamps to be added to or removed from the lamp supports as desired.

Another object and advantage of the lamp fixture is that it can be suspended from an angled surface, such as a sloped ceiling. This allows the fixture to be mounted in more spaces where light is required. This is accomplished by the pivotal connection of the hangers to the clamp bodies. The pivotal connection also allows the fixture to sway slightly if moved, thereby absorbing some of the energy from an impact or shift in the supporting structure, as in the event of an earthquake.

The foregoing and other advantages of the invention will appear from the following description. In that description reference is made to the accompanying drawings which form a part hereof and in which there is shown by way of illustration preferred embodiments of the invention. These embodiments do not represent the full scope of the invention. Thus, the claims should be looked to in order to judge the full scope of the invention.

BRIEF DESCRIPTION OF THE DRAWINGS

FIG. 4 is a partial exploded perspective view showing one lamp support with a lamp, support arms and a clamp body;

FIG. 5 is an enlarged view of the clamp body of FIG. 4;

FIG. 10 is a perspective view of an alternate embodiment of the invention in which the lamp support supports two lamps;

FIG. 11 is a bottom plan view of an alternate array; and

FIG. 12 is a bottom view of another alternate array.

DETAILED DESCRIPTION OF THE PREFERRED EMBODIMENTS

Figure 1:
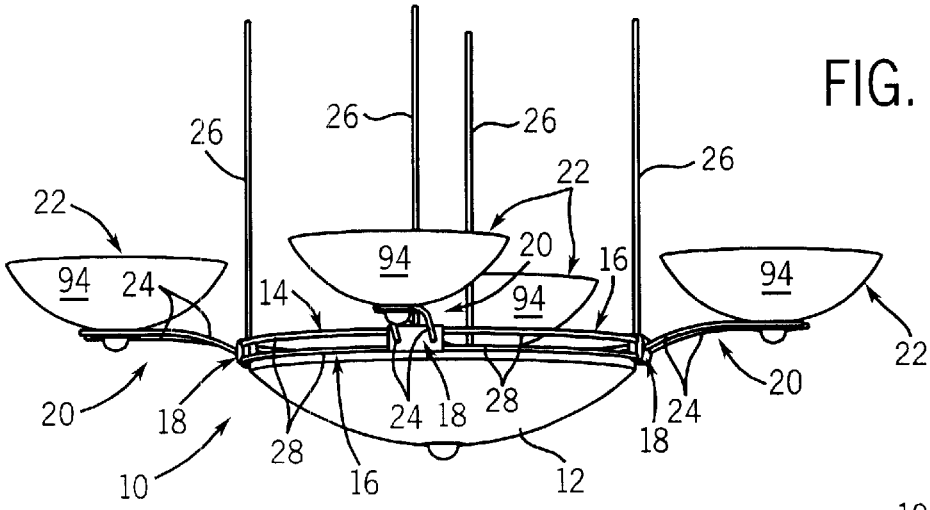
FIG. 1 is a perspective view of a lighting fixture according to the present invention.
Figure 2:
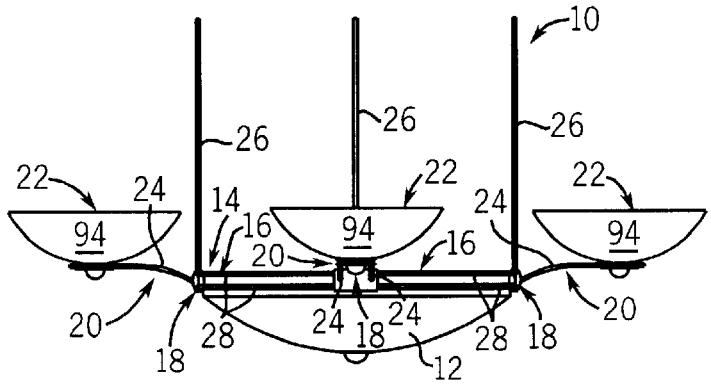
FIG. 2 is a front plan view thereof.
Figure 3:
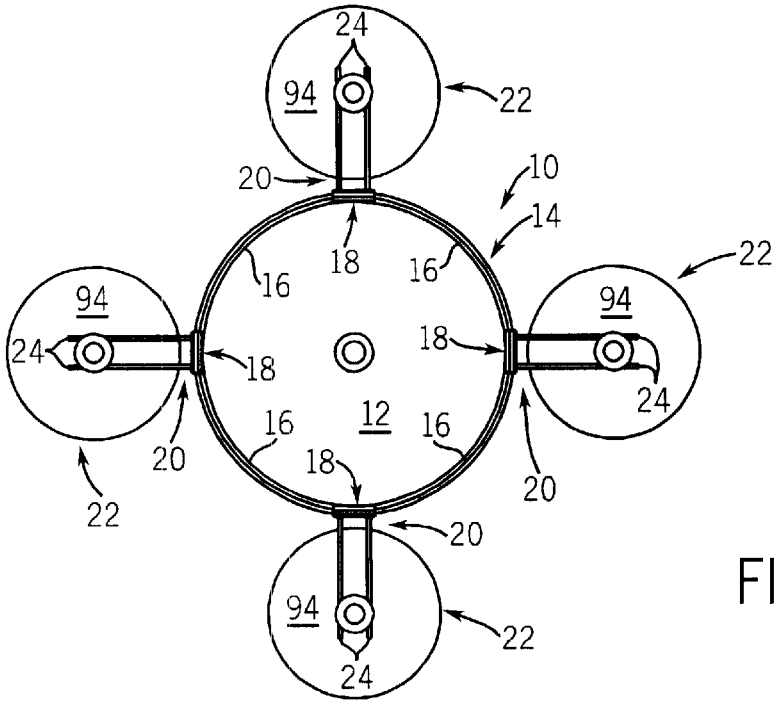
FIG. 3 is a bottom plan view thereof.
Figure 6:
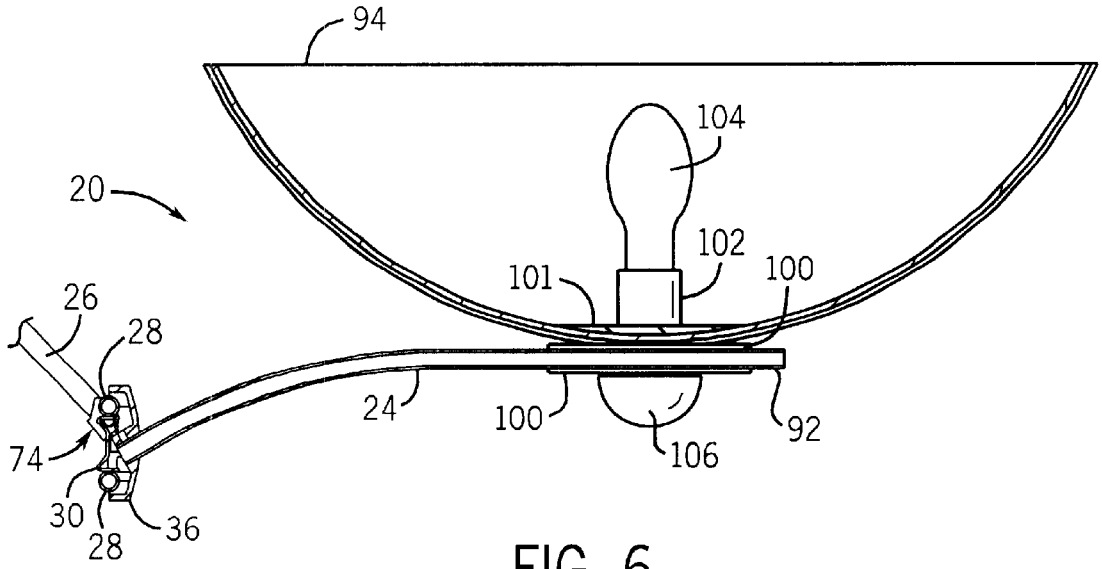
FIG. 6 is a partial cross-sectional view taken along line 6—6 of FIG. 4.

A modular lighting fixture 10 is shown in FIGS. 1—3 having a center lens 12 suspended by a hub 14 formed from a plurality of spacers 16 removably coupled to four clamp bodies 18, which are part of four lamp supports 20 mounting lamps 22 at support arms 24, which are in turn removably connected to the clamp bodies 18. Four hangers 26 extend from a ceiling or suspended support canopy (not shown) to the clamp bodies 18 to suspend the lighting fixture 10. The hangers 26 are preferably a suitable tubing, such as steel tubing having a ½ inch outer diameter and an inner diameter large enough to contain insulated electrical wires.

Referring to FIGS. 4 and 5, the spacers 16 are pairs of parallel, arcuate spacer tubes 28 defining substantially a 90 degree bend. Like the hangers 26, the spacer tubes 28 are preferably ½ inch OD steel tubing. Each spacer tube 28 is preferably joined together by two linking brackets 30 having bent ends (see FIG. 5) and extending between and preferably welded to the ends of the spacers tubes 28 without blocking the end openings 32. The linking brackets 30 are fastened to the clamp bodies 18 (as discussed below) to form the hub 14.

The clamp bodies 18 are formed of inner 34 and outer 36 parts, preferably made of a die cast aluminum, forming an inner cavity 38 when joined. As shown in FIG. 5, the inner part 34 has two counter-sunk openings 40 through the inner face 42 as well as two semi-circular recesses 44 at each end wall 46 and a recess 48 in the center of a top wall 50. The outer part 36 similarly includes two semi-circular recesses 52 at each end wall 54 and a recess 56 at a top wall 58. The recesses of the inner 34 and outer 36 parts thus define openings through which the spacer tubes 28 and hangers 26 extend.

Figure 7:
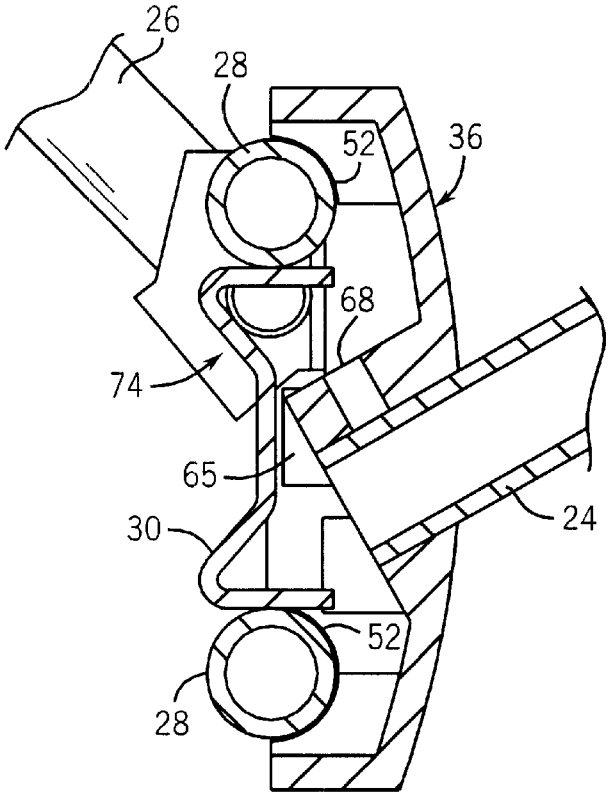
FIG. 7 is an enlarged cross-sectional view of the clamp body as shown in FIG. 6.
Figure 8:
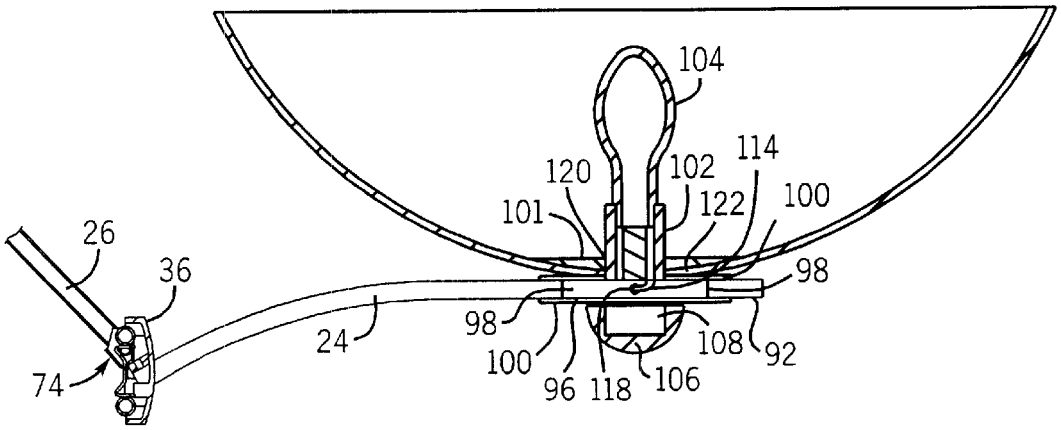
FIG. 8 is a side cross-sectional view taken along line 8—8 of FIG. 4.
Figure 9:
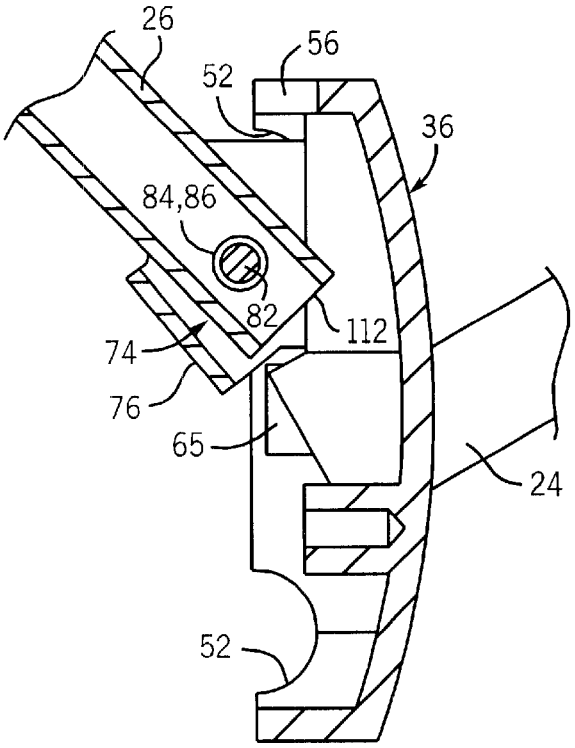
FIG. 9 is an enlarged partial cross-sectional view of the clamp body as shown in FIG. 8.

Referring particularly to FIGS. 5 and 7, the outer parts 36 of the clamp bodies 18 include two wedge-shaped mounting blocks 60 projecting into the cavity 38. Each mounting block 60 defines a cylindrical opening 62 and two raised bosses 64 and 65 with threaded bores 66. The cylindrical openings 62 receive an end of the support arms 24 for supporting the lamps 22. The support arms 24 are secured in place by a set screw (not shown) threaded into transecting threaded bores 68. The spacers 16 are mounted to the clamp bodies 18 by aligning openings 70 in the linking brackets 30 with the threaded bores 66 of the raised bosses 64 and 65 and threading a screw (not shown) into the bores of the inner bosses 64. The inner part 34 is attached to the outer part 36, and the spacers 16 are further secured to the clamp bodies 18, by inserting a screw through the counter-sunk openings 40 in the inner part and slots 72 of the linking brackets 30 and threading them into the bores of the outer bosses 65.

The hangers 26 are mounted to the clamp bodies 18 preferably at a steel pivot bracket 74. The pivot bracket 74 forms a clevis 76 disposed between two flanges 78 having openings 80 receiving screws for threading the pivot bracket 74 to the outer part 36. A clevis pin 82 joins the hangers 26 to the clevis 76 through openings 84 in the clevis 76 and openings 86 through the ends of the hangers 26. The clevis pin 82 is prevented from sliding through the clevis 76 by an enlarged head 86 and a cotter pin 88 disposed through a transverse opening 90 at the end of the clevis pin 78 opposite the head 86. The oblong opening formed by the joined recesses 48 and 56 of each of the inner 34 and outer 36 parts, respectively, provides space for each hanger 26 to pivot with respect to the clamp body 18 through approximately 45 degrees. This allows the hangers 26 of the lighting fixture 10 to be mounted directly to an angled surface, such as a sloped ceiling, or mounted to a smaller support canopy (not shown) above the fixture. In the latter case, the hangers 26 angle inwardly to connect to the support canopy, which is mounted to the sloped surface by one or more additional hangers. This can also provide resistence to the shock of impact.

When the lighting fixture 10 is hanging from the sloped surface, the oblong openings at the top of the clamp bodies 18 are obstructed by the hangers 26, which extend obliquely therethrough so that extraneous objects cannot enter the clamp bodies 18. In particular, the openings in the clamp bodies 18 are sufficiently small to meet the certification standards of Underwriters Laboratories, Inc.

The pivotal connection is not necessarily needed when the lighting fixture 10 is mounted horizontally. Thus, the pivot bracket 74 could be replaced with a suitable fixed connection and recess 48 could be semi-circular rather than oblong so that the cavity 38 of each clamp body 18 is completely enclosed.

The support arms 24 preferably bend slightly upwardly from the clamp bodies 18 to support the lamps 22 at free ends 92. The support arms 24 are preferably ½ inch OD steel tubing. Each lamp 22 includes a shade 94 mounted to a U-bracket 96 having upright ends 98 with semi-circular recesses (not shown) at side edges to cradle inner portions of the support arms 24. The free ends 92 of the support arms 24 are welded to the U-bracket 96. To conceal the U-bracket 96, two floating washers 100 are disposed at its top and bottom sides with the support arms 24 extending therebetween.

A mounting plate 101 disposed in the base of the shade 94 supports a light socket 102 for receiving a standard wattage light bulb 104. Preferably, metal halide bulbs are used ranging from 35–150 watts, however, incandescent and flourescent bulbs may be used as well. Moreover, sockets capable of larger wattage, such as 175–400 watts, can also be used. In any case, the socket 102, shade 94, and washers 100 are mounted to the U-bracket 96 (and thus the support arms 24) by three threaded fasteners (not shown) extending up from below the U-bracket 96 through corresponding openings in these components. The fasteners are threaded into thumb screws accessible from above the shade 94. A decorative fitter or accent piece 106 is secured below the U-bracket 96 by three additional fasteners (not shown) extending down through openings in the shade 94, washers 100, U-bracket 96 and engaging threaded bores in the accent piece 106. The accent piece 106 defines an upwardly opening cavity 108 which can be used to accommodate larger (high-wattage) sockets than shown in the drawings.

The light sockets 102 are electrically connected to a power source in parallel with the other light sockets of the other lamps 22 in the fixture 10 by insulated conductors running through the tubing of the lighting fixture 10. Specifically, two insulated wires 110 run through each hanger 26 and out the bottom end opening 112 inside the clamp bodies 18. The two conductors run inside the clamp body 18 and are connected by solder or wire-nuts to conductors 114 extending through the end openings 116 of the support arms 24. The conductors exit the support arms 24 at openings 118 at the free ends 92 and couple to terminals (not shown) of the light socket 102 through openings 120 and 122 in the mounting plate 101 and the base of the shade 94, respectively. This is the preferred method when using metal halide bulbs in which the sockets have ballasts remote from the lamps.

When using sockets for incandescent bulbs (requiring no ballast) or fluorescent bulbs (having an integral ballast), the lamps 22 can be powered in a parallel electrical connection by a single pair of leads running through only one hanger 26. The lamps 22 are coupled together by jumper leads running through each spacer tube 28. In this case, only one of the hangers 26 need be tubular, such that the other could be solid rods, chains, wires or cables.

FIGS. 10–12 show variations to the above described embodiment of the invention. In particular, FIG. 10 illustrates that one or more of the clamp bodies could be modified to include cylindrical openings 62A (shown in phantom) in the inner part 34 so that additional support arms 24A can be connected to the clamp bodies 18A in a similar manner for mounting two lamps 22 and 22A extending in opposite directions at each clamp body 18A. Preferably, each lamp would be coupled to power by separate wires running through the hanger 26, however, both lamps 22 and 22A could be connected with a single wire.

FIGS. 11 and 12 illustrate the flexibility of the lighting fixture of the present invention in that by changing the bend and/or length of some or all of the spacer tubes the overall configuration of the lighting fixture can be altered. As shown in FIG. 11, for example, without changing anything else the four arcuate spacers 16 described above could be replaced with two straight spacers 16B' and two 180 degree bend spacers 16B" to form an oblong lighting fixture 10B. By changing the spacers the lighting fixture could be configured to not form a closed path. As shown in FIG. 12, arcuate spacers 16C could be connected to the clamp bodies with alternating concavity to make a wavy or S-curve lighting fixture 10C.

Moreover, the look of the fixture can be changed readily by changing the shape of the shade. Various known shade configurations can be used including, for example, bowl-shaped, bell-shaped, cone-shaped, globe-shaped and any other desired configuration. Shades made of different material or having different translucence can also be used. For example, aluminum shades can be used to direct the light upward or acrylic shades can be used to allow light to shine in all directions. Still further, the lamps could be mounted to the support arms so that the shade opens downward to provide spot lighting.

Thus, the invention provides a modular cluster lighting fixture that can be easily assembled into various configurations and to have any number of lamps. This is accomplished by connecting the suspension elements, electrical conductors and the lamps to lamp supports, thereby allowing the spacers to be of any configuration and the lamps to be added to or removed from the lamp supports as desired. The fixture can be suspended at an angle or from a sloped ceiling. This increases the design choice of the fixture and allows it to be mounted in more spaces where light is required.

While specific embodiments of the present invention have been described above, various modifications falling within the breadth and scope of the invention will be apparent to one skilled in the art. Thus, the following claims should be looked to in order to understand the full scope of the invention.

Industrial Applicability

The above disclosed invention provides a modular cluster lighting fixture that can be easily assembled into various configurations and to have any number of lamps.

I claim:

1. A lighting fixture, comprising:

two lamp supports;

two lamps, each of said lamps being supported by one of the lamp supports;

a spacer structure;

two hangers for supporting the lighting fixture from above;

two clamp bodies;

a first of said clamp bodies being connected to a first of said hangers, receiving a first end of the spacer structure, and being connected to a first of the lamp supports;

a second of said clamp bodies being connected to a second of said hangers, receiving an end of the spacer structure opposite the first end of the spacer structure, and being connected to a second of the lamp supports; and electrical wiring extending along at least one of the hangers so as to provide an electrical connection through the clamp bodies and lamp supports to the lamps.

2. The lighting fixture of claim 1, wherein each clamp body receives a spacer structure via an opening at an end of the clamp body, connects to a lamp support along a side of the clamp body, and connects to a hanger adjacent a top of the clamp body.

3. The lighting fixture of claim 2, wherein each lamp includes a shade.

4. The lighting fixture of claim 3, wherein the spacer structure is tubular.

5. The lighting fixture of claim 4, further comprising a bracket for connecting the spacer structure to one of said clamp bodies.

6. The lighting fixture of claim 5, wherein one of said clamp bodies has separate inner and outer parts fastened together.

7. The lighting fixture of claim 6, wherein one of said hangers is connected to one of said clamp bodies via a pivotal connection.

8. The lighting fixture of claim 6, wherein there are a plurality of the spacer structures and clamp bodies which are configured and connected to form a closed path.

9. The lighting fixture of claim 6, wherein there are a plurality of the spacer structures and clamp bodies which are configured and connected to form an open-ended path.

10. A lighting fixture, comprising:

two lamp supports;

two lamps, each of said lamps being supported by one of the lamp supports;

a hanger for supporting the lighting fixture from above;

a clamp body; and electrical wiring extending along the hanger through the clamp body and lamp supports and to the lamps;

wherein the clamp body has a first clamp part and a second clamp part that join, one lamp support extends in a first direction from the first clamp part, the other lamp support extends in an essentially opposite direction from the second clamp part, and the hanger connects to the clamp body through an opening between the clamp parts.

* * * * *